US006746233B2

(12) United States Patent
Zabriskie et al.

(10) Patent No.: US 6,746,233 B2
(45) Date of Patent: Jun. 8, 2004

(54) SEMI-AUTOMATIC GAS PILOT ORIFICE CLEAN-OUT DEVICE

(75) Inventors: Thomas C. Zabriskie, LaCrosse, WI (US); John L. Tomlinson, LaCrosse, WI (US)

(73) Assignee: L. B. White Co., Inc., Onalaska, WI (US)

( * ) Notice: Subject to any disclaimer, the term of this patent is extended or adjusted under 35 U.S.C. 154(b) by 0 days.

(21) Appl. No.: 10/254,904

(22) Filed: Sep. 25, 2002

(65) Prior Publication Data

US 2003/0073050 A1 Apr. 17, 2003

Related U.S. Application Data

(60) Provisional application No. 60/324,643, filed on Sep. 25, 2001.

(51) Int. Cl.[7] ..... F23D 11/38; F23D 14/50

(52) U.S. Cl. ..... 431/123; 239/117; 137/244

(58) Field of Search ..... 431/123, 122, 431/121, 32, 3; 239/117, 116, 115, 114, 106, 104; 15/104.03, 104.05; 137/242, 244; 362/458

(56) References Cited

U.S. PATENT DOCUMENTS

| | | | | |
|---|---|---|---|---|
| 742,990 | A | 11/1903 | Humphrey | 431/123 |
| 1,837,861 | A | 1/1931 | Green et al. | 239/117 |
| 2,626,185 | A | 1/1953 | Roselund | 239/117 |
| 3,485,567 | A | 12/1969 | Hutchinson et al. | 431/210 |
| 3,726,629 | A | 4/1973 | Eschman | 431/123 |
| 3,807,938 | A | 4/1974 | Hastings | 431/123 |
| 3,876,364 | A | 4/1975 | Hefling | 431/123 |
| 4,522,582 | A | 6/1985 | Curtis | 431/123 |
| 4,629,120 | A | 12/1986 | Diamond | 137/244 |
| 5,149,260 | A | 9/1992 | Foust | 431/32 |
| 5,417,565 | A | 5/1995 | Long | 431/231 |
| 5,513,624 | A | 5/1996 | Vorhis | 431/123 |
| D374,716 | S | 10/1996 | Anderson et al. | D23/415 |
| D374,717 | S | 10/1996 | Anderson et al. | D23/415 |
| 5,575,639 | A | 11/1996 | Pearl, II | 431/123 |
| 5,655,512 | A | 8/1997 | Long | 431/123 |
| 6,056,540 | A | 5/2000 | Newman et al. | 431/264 |

FOREIGN PATENT DOCUMENTS

| | | |
|---|---|---|
| DE | 199 12 283 | 9/2000 |
| JP | 2001-50516 | 2/2001 |

*Primary Examiner*—Josiah Cocks
(74) *Attorney, Agent, or Firm*—Fredrikson & Byron PA

(57) ABSTRACT

A semi-automatic gas pilot clean-out device and a gas pilot with the device useful in agricultural brooders and other appliances that utilize a gas pilot as an ignition source. The device has a plunger rod with a clean-out pin attached to one end and a push button assembly attached to the other end. The assembly when mounted within a gas pilot housing can be actuated by manually pressing the button of the assembly to move the plunger rod toward a gas outlet of the gas pilot so that the tip of the clean-out pin passes through the gas outlet, removing debris therefrom. When pressure is no longer applied to the button, the assembly returns to an open position.

14 Claims, 3 Drawing Sheets

SEMI-AUTOMATIC GAS PILOT ORIFICE CLEAN-OUT DEVICE

This application claims the benefit of Provisional Application No. 60/324,643, filed Sep. 25, 2001.

FIELD OF THE INVENTION

This invention relates to a device for cleaning out the orifice of a gas pilot in appliances or devices that utilize a gas pilot as an ignition source. More specifically, it relates to a device for cleaning out the pilot flame gas orifice in agricultural brooders incorporating a pilot flame gas orifice.

BACKGROUND OF THE INVENTION

An agricultural brooder is operated in a humid, corrosive environment containing airborne particulates and other matter, such as animal dust and debris, as well as dust and debris from feed supplies. Other appliances and devices that utilize gas pilot similarly may be operated in environments containing airborne particulates and other matter from a variety of sources present in those environments.

With respect to agricultural brooders, there are times during the growing cycle when there can be a high degree of air movement within the building. There are also periods during the growing cycle when the agricultural brooder is not in operation During these times, there is opportunity for the pilot flame gas orifice, also referred to herein as a pilot orifice, to become partially or wholly blocked with debris from the environment. Further, the gas supply lines that carry gas to a gas pilot may become contaminated with dust or other debris, clogging the pilot orifice.

When such blockages occur, the pilot orifice in an agricultural brooder or other appliance will require cleaning in order to restore proper function, allowing unobstructed gas flow to the orifice.

The construction of a gas pilot and/or of the pilot flame gas orifice, the associated mounting hardware and gas-tight plumbing fittings, and the location of such an orifice within the gas pilot or other appliance can make cleaning of the pilot orifice difficult and time consuming. This is particularly true where the construction and configuration of the gas pilot requires disassembly for the purpose of manual cleaning of the gas pilot and its orifice, followed by reassembly to return the gas pilot to operation.

A mechanism for achieving the cleaning function without disassembling the gas pilot, its orifice or its associated plumbing and mounting hardware would therefore be desirable and advantageous. Such a mechanism or device must incorporate materials and a design so as to remain gas-tight and provide a reliable function within a hostile environment and at the elevated temperatures to which it is exposed. The clean out device of the invention is such a mechanism or device.

SUMMARY OF THE INVENTION

Figure 1:
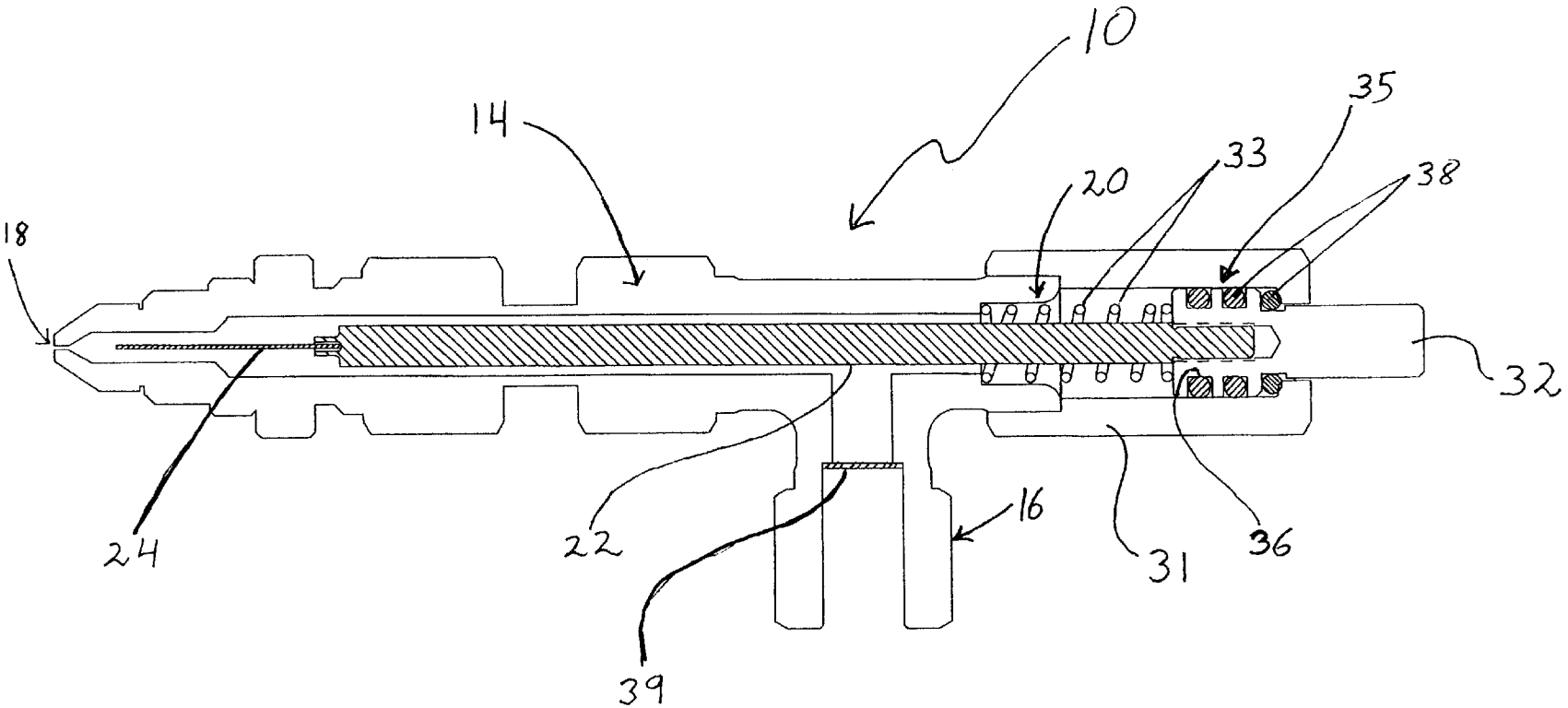
FIG. 1 is a sectional view of pilot flame gas pilot with a clean-out device according to the invention.

The invention is directed to a semi-automatic gas pilot orifice clean-out device and to gas pilots incorporating clean-out device. In one embodiment of the invention, the clean-out device is an actuating mechanism for cleaning out the exit of a gas pilot orifice of a T-shaped gas pilot of an agricultural brooder or other appliance that utilizes a gas pilot as an ignition source. The T-shaped gas pilot is formed of a T-tube having an inlet port, an exit port to which the pilot orifice is attached and a gas pilot opening adapted to receive the actuating mechanism. The actuating mechanism is comprised of a plunger rod, a clean-out pin and a push button assembly. The plunger rod has a free end and a secured end. The clean-out pin is mounted to the free end of the plunger rod and has a diameter size to allow it to pass through the pilot orifice. The push button assembly is attached to the secured end of the plunger. The assembly is comprised of a push button nut, a push button mounted within the push button nut, and a spring. The push button nut is for securing the assembly to the gas pilot opening. The push button has a gas-tight seal to prevent entry of contaminants and debris into the gas pilot. The actuating mechanism is actuated by the push button to push the plunger rod in the direction of the gas orifice. The spring is for returning the plunger rod to an open position. The spring is located around the plunger and substantially between the push button and the opening of the pilot.

In another embodiment of the invention the actuating mechanism is comprised of a plunger rod, a clean-out pin, and a push button assembly. The plunger rod has a free end and a secured end. The clean-out pin is mounted to the free end of the plunger rod and has a diameter sized to allow it to pass through the pilot orifice. The push button assembly is attached to the secured end of the plunger. The assembly is comprised of a push button nut, a push button, and a spring. The push button nut is for securing the assembly to the gas pilot opening. The push button is mounted within the push button nut. The push button has at least three annular grooves with an O-ring positioned in each groove in order to provide a gas-tight seal and has an internal recess for receiving the secured end of the plunger rod. The plunger rod is secured within the recess. The spring is located around the plunger rod and substantially between the push button and the opening, so that when the spring is extended gas flows through the gas pilot and when the spring is compressed the clean-out pin passes through the gas pilot orifice.

In another embodiment the invention is directed to a semi-automatic gas pilot orifice clean-out device. The clean-out device is for cleaning a gas pilot orifice of an agricultural brooder or other appliance having a gas pilot, a gas supply, and a gas supply line connecting the gas supply to the gas pilot. The clean-out device comprises a T-shaped tube, a section of tubing, and an actuating mechanism. The T-shaped tube has an inlet port adapted for attachment to the gas supply line, an exit port and an actuating mechanism opening. The inlet and exit port being in flow-through communication and the opening being coaxial with and opposite the exit port. The section of tubing is attached to the exit port and bears an orifice holder opposite the exit port. The section of tubing having a gas pilot orifice secured in the orifice holder. The actuating mechanism is sized and mounted within the device so as to provide an optimized internal flow path allowing unrestricted flow of gas through the device when the mechanism is not actuated. The actuating mechanism is comprised of a plunger rod, a clean-out pin, and a push button assembly. The plunger rod has a free end and a secured end. The clean-out pin is mounted to the free end of the plunger rod and the pin has a diameter sized to allow it to pass through the pilot orifice. The push button assembly is attached to the secured end of the plunger. The assembly is comprised of a push button nut, a push button, and a spring. The push button nut is for securing the assembly to the gas pilot opening. The push button is mounted within the push button nut and has a gas-tight seal and to prevent entry of contaminants and debris into the gas pilot. The spring is located around the plunger and substantially between the push button and the opening of the pilot.

In another embodiment of the device of the invention, the clean-out device is comprised of a T-shaped tube, a section of tubing, and an actuating mechanism. The T-shaped tube has an inlet port adapted for attachment to a gas supply line, an exit port and a gas pilot opening. The inlet and exit port are in flow-through communication. The opening being coaxial with and opposite the exit port. The section of tubing is attached to the exit port. The tubing bears an orifice holder opposite the exit port and has a pilot orifice secured in the orifice holder. The actuating mechanism has a redundant sealing system and is sized and mounted within the device so as to provide an optimized internal flow path allowing unrestricted flow of gas through the device when the mechanism is not actuated. The actuating mechanism is comprised of a plunger rod, a clean-out pin, and a push button assembly. The plunger rod has a free end and a secured end. The clean-out pin is mounted to the free end of the plunger rod and has a diameter sized to allow it to pass through the pilot orifice. The push button assembly is attached to the secured end of the plunger. The pushbutton assembly is comprised of a push button nut, a push button and a spring. The push button nut is for securing the assembly to the gas pilot opening. The push button is mounted within the push button nut. The push button nut has at least three annular grooves with an O-ring positioned in each groove in order to provide a gas-tight seal. The push button has an internal recess for receiving the secured end of the plunger rod and the plunger rod is secured within the recess. The spring is located around the plunger rod and substantially between the push button and the opening, so that when the spring is extended gas flows through the gas pilot and when the spring is compressed the clean-out pin passes through the gas pilot orifice.

In another embodiment the invention is a gas pilot with a semi-automatic clean-out device. The gas pilot is comprised of a tubular housing having a longitudinal length and two ends, a gas orifice with an orifice exit port, a gas pilot opening at the end of the housing, a gas inlet port, and an actuating mechanism coaxially located within the housing. The gas orifice is located at one end of the housing and the opening is at the other end of the housing. The opening is configured and adapted to receive the actuating mechanism. The gas inlet port is configured for flow-through attachment to a gas supply. In this embodiment the actuating mechanism is comprised of a plunger rod having a free end bearing a clean-out pin and a secured end, and a push button assembly in sealed attachment to the gas pilot opening. The plunger moves towards the gas orifice and pushes the clean-out pin through the orifice exit port when the actuating mechanism is actuated and returns to an open position when the mechanism is not actuated.

In another embodiment of the gas pilot with semi-automatic clean-out device, the gas pilot is comprised of the tubular housing as describe above and an actuating mechanism. The actuating mechanism is comprised of a plunger rod, a clean-out pin, and a push button assembly. The plunger rod has a free end and a secured end. The clean-out pin is mounted to the free end of the plunger rod and the pin has a diameter size to allow it to pass through the pilot orifice. The push button assembly is attached to the secured end of the plunger. The assembly is comprised of a push button nut, a push button, and a spring. The push button nut is for securing the assembly to the gas pilot opening. The push button is mounted within the push button nut and has a redundant sealing system to provide a gas-tight seal and to prevent entry of contaminants and debris into the gas pilot. The spring is located around the plunger and substantially between the push button and the opening of the pilot.

In another embodiment of the gas pilot with automatic clean-out device, the actuating mechanism is comprised of a plunger rod, a clean-out pin, and a push button assembly. The plunger rod has a free end and a secured end. The clean-out pin is mounted to the free end of the plunger rod and has a diameter size to allow it to pass through the pilot orifice. The push button assembly is attached to the secured end of the plunger. The assembly is comprised of a push button nut, a push button, and a spring. The push button nut is for securing the assembly to the gas pilot opening. The push button is mounted within the push button nut. The push button has at least annular grooves with an O-ring positioned in each groove in order to provide a gas-tight seal and having an internal recess for receiving the secured end of the plunger rod. The plunger rod is secured within the recess. The spring is located around the plunger rod and substantially between the push button and the opening, so that when the spring is extended gas flows through the gas pilot and when the spring is compressed the clean-out pin passes through the gas pilot orifice.

In another embodiment of invention, the gas pilot with semi-automatic clean-out device, comprises a T-shaped housing and a clean-out device. The housing is adapted and configured for flow-through communication with a gas supply line and has an inlet port, a gas outlet and an opening. The clean-out device is comprised of a plunger rod having a free end and a secured end, a clean-out pin mounted to the free end and a push button assembly attached to the secured end. The clean-out device is coaxially located within the housing and attached thereto by the push button assembly in sealed, gas-tight relationship. When the push button assembly is actuated, the plunger rod moves toward the gas outlet and the clean-out pin passes through the outlet; and when the clean-out device is not actuated, the plunger rod returns to an open position.

DETAILED DESCRIPTION OF THE INVENTION

A gas pilot 10 with semi-automatic clean-out device 12 is shown in FIG. 1. The clean-out device 12 may also be referred to herein as an actuating mechanism 12. The gas pilot 10 is generally T-shaped and may be viewed as tubular housing 14 having a longitudinal length with two opposed ends and a length of tubing 16 extending therefrom to provide the general T-shape. It should be recognized and understood that the term "T-shaped" may include a variety of shapes not corresponding exactly to a T-shape per se. Thus, the length of tubing 16 may be normal longitudinal axis of the housing 14 or at an angle relative to said axis of housing 14. The length of tubing 16 is adapted and configured for flow-through connection to a gas a gas supply line coming from a gas supply and may also be referred to herein as a gas inlet port 16.

The tubular housing 14 and the length of tubing preferably are generally circular if viewed in cross-section but may be of different shapes, such as a square, triangular or other cross-sectional shape. This is particularly applicable to the shape of the interior space or diameter of the tubing 14 in which the clean-out device 12 is disposed. The clean-out device or actuating mechanism 12 may be similarly shaped when viewed in cross-section. The cross-sectional shape of the tubing 16 and of the clean-out device 12 need not be the same, though they are preferably of correspondingly or relatively similar shape. More important than relative shape, the clean-out device should be configured, sized and shaped, to be received within tubular housing 14, and should be of at least slightly smaller diameter relative to the interior diameter of the housing 14.

Referring to FIG. 1, the housing 14 has an inlet port 16, a gas outlet 18 and a gas pilot opening 20. The clean-out device 12 is received within the interior space of the housing 14 through the opening 20 and is coaxially located in the housing 14. When the clean-out device 12 is within and secured to the housing 14, the inlet port 16 and gas outlet 18 are in flow-through communication. The opening 20 and gas outlet 18 are located at opposite ends of the longitudinal length of the housing 12.

The clean-out device 12 or actuating mechanism 12 is formed of a plunger rod 22, a clean-out pin 24, and a push button assembly 30. The plunger rod 22 has a free end and secured end. When the clean-out device is positioned within the housing 14, the free end of the plunger rod 22 is located near the end of the housing having the gas outlet 18 and the secured end is located near the gas pilot opening 20. The clean-out pin 24 is mounted to the free end of the plunger rod 22 and is sized to pass through the gas outlet 18. The push button assembly 30 is attached to the secured end of the plunger rod 20. When the clean-out device 12 is received within the housing 14, the push button assembly 30 is secured to the open end of the housing 14.

Referring again to FIG. 1, the push button assembly is comprised of a push button nut 31. a push button 32, and a spring 33. The push button nut 31 secures the assembly 30 to the gas pilot opening 20. The push button 32 is mounted within the push button nut 31. The push button 32 has gas-tight seal 35 to prevent entry of contaminants and debris into the gas pilot. As depicted in FIG. 1, the gas-tight seal 35 is a redundant sealing system formed of three annular grooves 36 with an O-ring 38 positioned in each groove. The gas-tight seal can be formed of single O-ring in an annular groove, two O-rings each in an annular groove, or three or more O-rings each within separate annular. Other suitable means for forming a gas-tight seal know to those skilled in the art may be used.

Figure 2:
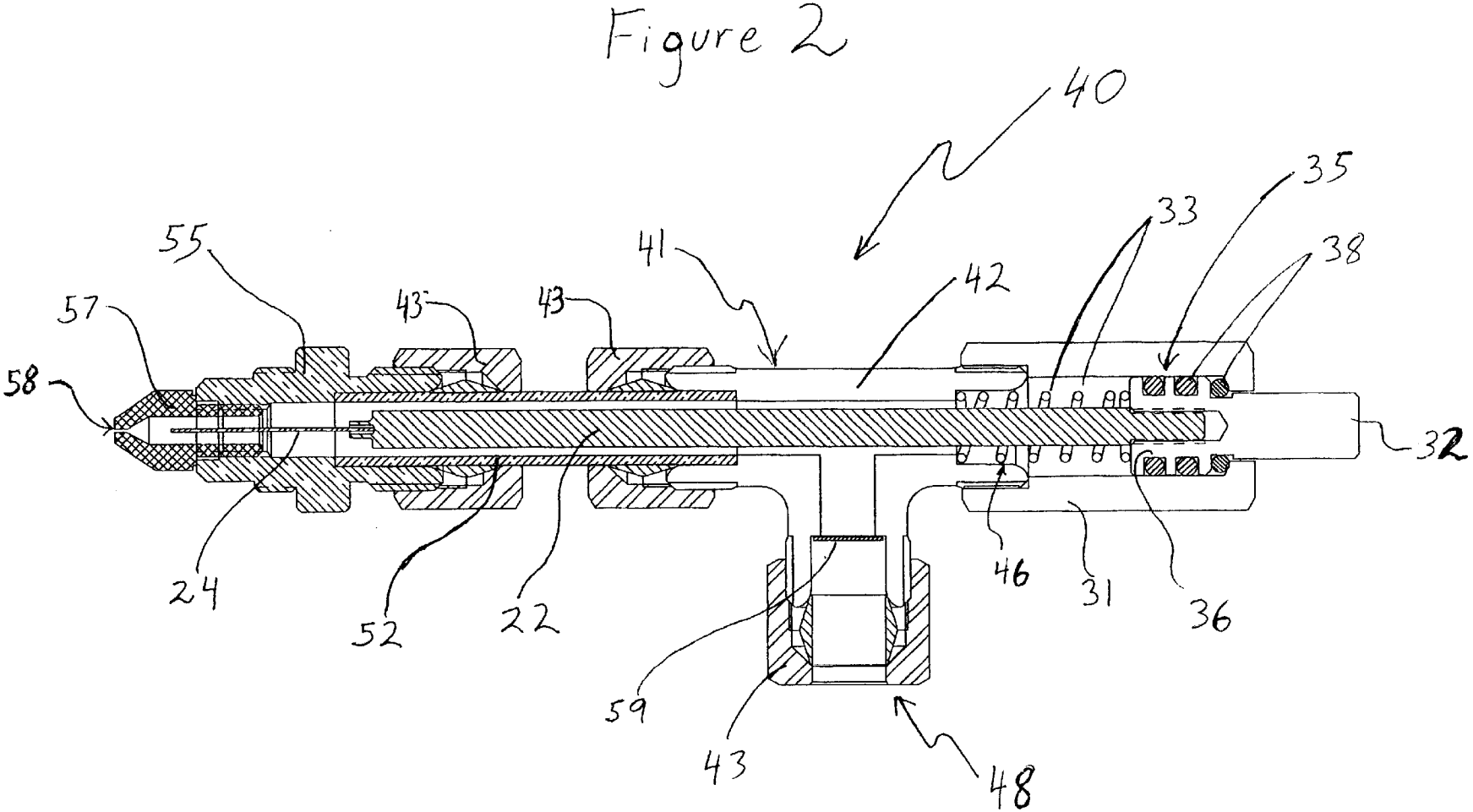
FIG. 2 is a sectional view of a pilot flame gas pilot with a clean-out device according to the invention.
Figure 3:
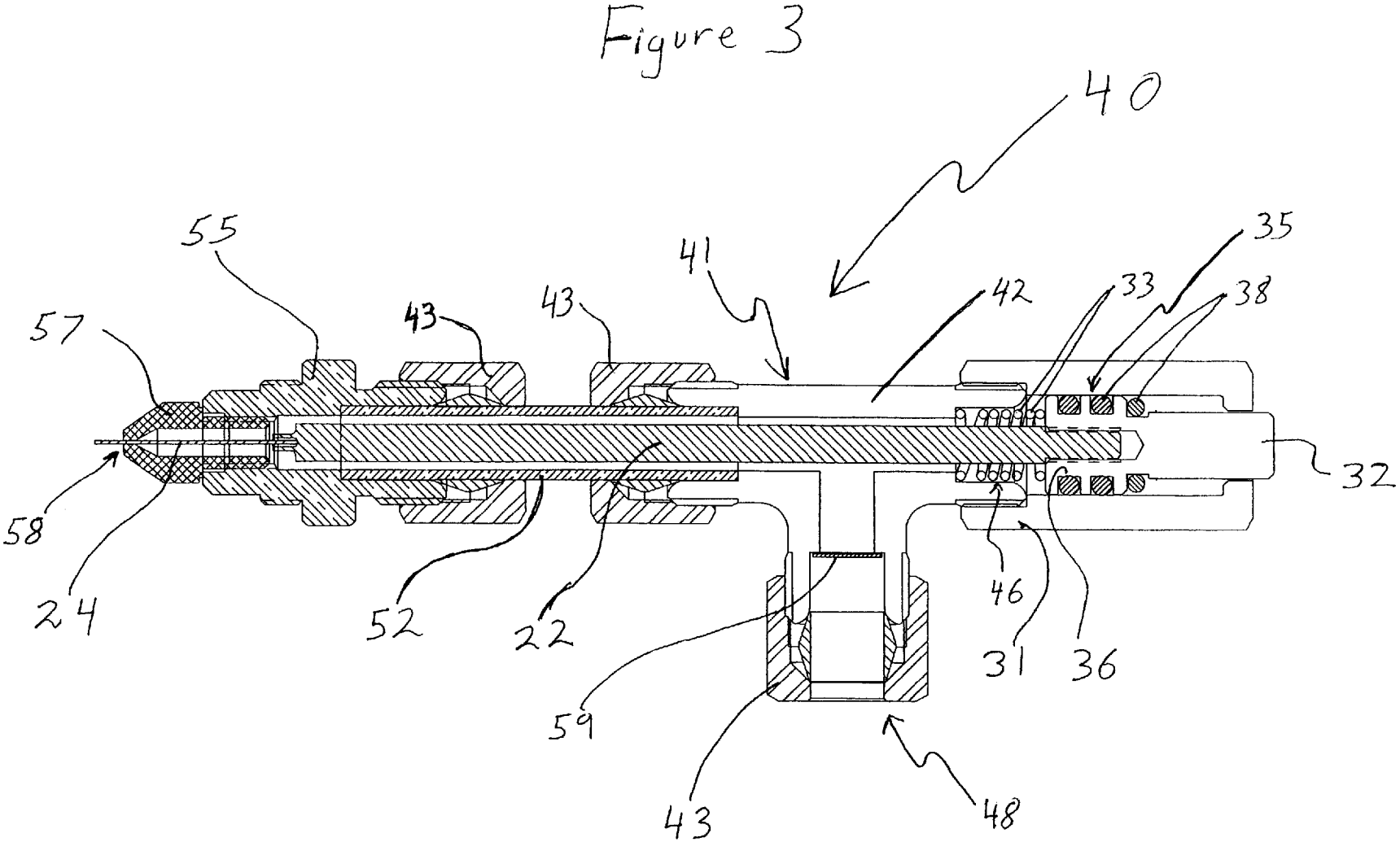
FIG. 3 is a sectional view of a pilot flame gas pilot with a clean out device according to the invention.

The push button 32 of the assembly 30 has a internal recess for receiving the secured end of the plunger rod. The spring 33 is located around the plunger rod 22 and substantially between the push button 32 and the gas pilot opening 20. The spring 33 is located here so that when the spring 33 is in the extended or open position gas flows through the gas pilot 10; and when the spring 33 is compressed, the clean-out pin 24 passes through the gas outlet 18. The clean-out device or actuating mechanism 12 is actuated by pressing the push button 32 moving the plunger rod 22 and pushing the clean-out pin 24 toward and through the gas outlet 18. When actuated the spring 33 is compressed. When pressure is no longer applied to the push button 32, the spring returns the actuating mechanism 12 to an open position and the spring 33 is extended, allowing unrestricted gas flow through the gas pilot 10. The actuating mechanism or clean-out device 12 should be sized and mounted within the gas pilot so as to provide an optimized internal flow path allowing unrestricted flow of gas through the gas pilot when the mechanism is not actuated. In FIGS. 2 and 3, the actuating mechanism 12 can be seen, respectively, in open and actuated positions.

The gas supply line carrying gas to a gas pilot 10 may become contaminated with dust and debris which may pass into and clog outlet 18. To prevent this from occurring, a fine mesh screen or filter 39 may be disposed within the gas inlet port 16 as shown in FIG. 1.

In another embodiment of the invention, the housing of the gas pilot is not of a unitary construction as depicted in FIG. 1; rather, it is constructed with multiple components. Turn now to FIGS. 2 and 3, a gas pilot of constructed of multiple components is shown. The actuating mechanism or clean out device is substantially as described herein above.

With reference to FIGS. 2 and 3, the gas pilot 40 if formed of housing 41 with a T-tube 42 and clean out device 12. The T-tube 42 can be any commercially available "tee" tube fitting formed of suitable, such a commercially manufactured automotive "tee" tube fitting as described in SAE J512. The T-tube 42 has an exit port 44, gas pilot opening 46 and an inlet port 48. The gas pilot opening 46 serves the same purpose as gas pilot opening 20, described above relative to FIG. 1. When the clean-out device 12 is received within gas pilot opening 46, the push button assembly 30 is secured to opening 46 by push button nut 31.

The exit port 44 is secured to a section of tubing 52 with a retaining nut or nut 53. Tubing 52 is similarly connected and secured to an orifice holder 55 with a nut 53. The orifice holder 55 is connected to an orifice 57 having a gas outlet 58 through which the clean-out pin 24 passes when the clean-out device 12 is actuated. and sleeve. The inlet port 48 is shown in FIGS. 2 and 3 with a fine mesh screen or filter 59 for preventing contaminants and debris that may be in the gas supply line from entering and clogging the gas pilot 40. The inlet port 48 is adapted and configured for flow-through connection to a gas supply line. Nut 53 may be utilized for this purpose. Retaining nut 53 and associate ferrule or sleeve connects and seals the components so gas does not seep or flow out of the gas pilot. The housing 41 is made up of T-tube 42, tubing 52, orifice holder, orifice 57, and a means of sealed connection. The means for sealed connection depicted in FIGS. 2 and 3 are retaining nuts but other suitable means known to those skilled in the art may be utilized.

The clean-out device 12 is received within the interior space of the housing 41 through the opening 46 and is coaxially located in the housing 41. When the clean-out device 12 is within and secured to the housing 41, the inlet port 48 and gas outlet 58 are in flow-through communication. The opening 46 and gas outlet 58 are located at opposite ends of the longitudinal length of the housing 41.

The clean-out device 12 or actuating mechanism 12 is formed of a plunger rod 22, a clean-out pin 24, and a push button assembly 30. The plunger rod 22 has a free end and secured end. When the clean-out device is positioned within the housing 14, the free end of the plunger rod 22 is located near the end of the housing having the gas outlet 18 and the secured end is located near the gas pilot opening 20. The clean-out pin 24 is mounted to the free end of the plunger rod 22 and is sized to pass through the gas outlet 18. The push button assembly 30 is attached to the secured end of the plunger rod 20. When the clean-out device 12 is received within the housing 14, the push button assembly 30 is secured to the open end of the housing 14.

Referring again to FIGS. 2 and 3, the push button assembly is comprised of a push button nut 31. a push button 32, and a spring 33. The push button nut 31 secures the assembly 30 to the gas pilot opening 20. The push button 32 is mounted within the push button nut 31. The push button 32 has gas-tight seal 35 to prevent entry of contaminants and debris into the gas pilot. As depicted in FIGS. 2 and 3, the gas-tight seal 35 is a redundant sealing system formed of three annular grooves 36 with an O-ring 38 positioned in each groove. The gas-tight seal can be formed of single O-ring in an annular groove, two O-rings each in an annular groove, or three or more O-rings each within separate annular. Other suitable means for forming a gas-tight seal know to those skilled in the art may be used.

The push button 32 of the assembly 30 has a internal recess for receiving the secured end of the plunger rod. The spring 33 is located around the plunger rod 22 and substantially between the push button 32 and the gas pilot opening 46. The spring 33 is located here so that when the spring 33 is in the extended or open position gas flows through the gas pilot 40; and when the spring 33 is compressed, the clean-out pin 24 passes through the gas outlet 58. The clean-out device or actuating mechanism 12 is actuated by pressing the push button 32 moving the plunger rod 22 and pushing the clean-out pin 24 toward and through the gas outlet 58. When actuated the spring 33 is compressed. When pressure is no longer applied to the push button 32, the spring returns the actuating mechanism 12 to an open position and the spring 33 is extended, allowing unrestricted gas flow through the gas pilot 40. The actuating mechanism or clean-out device 12 should be sized and mounted within the gas pilot so as to provide an optimized internal flow path allowing unrestricted flow of gas through the gas pilot when the mechanism is not actuated. In FIGS. 2 and 3, the actuating mechanism 12 can be seen, respectively, in open and actuated positions.

The pins 24 can be straight wire crimped into the free end of the plunger rod. The diameter of the pin 24 should be slightly smaller than the orifice exit hole. Preferably, the pin 24 or straight wire has a clearance relative to the gas outlets 18, 58 of between about 0.000 to about 0.0018 inches. The clearance may be greater that 0.0018, but as the clearance increase, the opportunity for contaminants and debris to enter the gas pilot increases. The end of pin 24 may be rounded, pointed, flat or conical and, preferably, is free of burrs. The overall length of the plunger 22 and pin 24 is designed such that when the assembly is in its free state or open position with the spring 33 extended, there is clearance to and a free flow of gas to the gas outlet 18, 58. When the button 32 is manually pressed and the spring 33 is compressed, the tip of pin 24 passes through gas outlets 18, 58, removing any debris which would otherwise obstruct the free flow of gas through the gas pilot. When released, the assembly returns to its resting or open position and gas is free to flow through the gas outlets 18, 58.

It is recognizable to those skilled in the art that the components of the gas pilot and the clean-out device of the invention should be made, formed or constructed of material suitable for use in the environment and under the operating conditions to which they will be subjected. For example, the materials should be able to withstand the temperatures reached when the gas pilot is lit a gas flame is burning. For example, the housing and actuating mechanism components may be made from metals, such as brass, or other temperature durable materials. Materials for components, such as the O-rings, may be sensitive to corrosives that may be present in the environment and the material utilized for such components should be selected for the ability to withstand both the operating temperatures and a corrosive environment. Preferably, the O-rings are composed of a commercial high-temperature elastomer and are lubricated with a compatible commercial high-temperature valve sealant.

While exemplary embodiments of this invention and methods of practicing the same have been illustrated and described, it should be understood that various changes, adaptations, and modifications might be made therein without departing from the spirit of the invention and the scope of the appended claims.

What is claimed is:

1. An actuating mechanism for cleaning out the exit of a gas pilot orifice of a T-shaped gas pilot of an agricultural brooder or other appliance that utilize a gas pilot as an ignition source, the T-shaped gas pilot being formed of a T-tube having an inlet port, an exit port to which the pilot orifice is attached and a gas pilot opening adapted to receive the actuating mechanism, the actuating mechanism comprising:

a plunger rod having a free end and a secured end;

a clean-out pin mounted to the free end of the plunger rod, the pin having a diameter sized to allow it to pass through the pilot orifice; and a push button assembly attached to the secured end of the plunger, the push button assembly being comprised of:

a push button nut for securing the assembly to the gas pilot opening;

a push button mounted within the push button nut, the push button having a gas-tight, high-temperature, redundant seal to prevent gas leakage and entry of contaminants and debris into the gas pilot, the actuating mechanism being actuated by the push button to push the plunger rod in the direction of the gas orifice; and, a spring for returning the plunger rod to an open position, the spring being located around the plunger and substantially between the push button and the opening of the pilot.

2. An actuating mechanism for cleaning out the exit of a gas pilot orifice of a T-shaped gas pilot of an agricultural brooder or other appliance that utilizes a gas pilot as an ignition source, the T-shaped gas pilot being formed of a T-tube having a inlet port, and exit port to which the pilot orifice is attached and a gas pilot opening adapted to receive the actuating mechanism, comprising:

a plunger rod having a free end and a secured end;

a clean-out pin mounted to the free end of the plunger rod, the pin having a diameter sized to allow it to pass through the pilot orifice; and a push button assembly attached to the secured end of the plunger, the push button assembly being comprised of:

a push button nut for securing the assembly to the gas pilot opening;

a push button mounted within the push button nut, the push button having at least three annular grooves with a high-temperature O-ring positioned in each groove in order to provide a gas-tight, redundant seal and having an internal recess for receiving the secured end of the plunger rod, the plunger rod being secured within the recess; and a spring located around the plunger rod and substantially between the push button and the opening, so that when the spring is extended gas flows through the gas pilot and when the spring is compressed the clean-out pin passes through the gas pilot orifice.

3. A semi-automatic gas pilot orifice clean-out device for cleaning a gas pilot orifice of an agricultural brooder or other appliance having a gas pilot, a pressurized gaseous fuel supply, a gas supply line connecting the gaseous fuel supply to the gas pilot, the clean-out device comprising:

a T-shaped tube having an inlet port adapted for attachment to the gas supply line, an exit port and an actuating mechanism opening, the inlet and exit port being in flow-through communication and the opening being coaxial with and opposite the exit port;

a section of tubing attached to the exit port, the section of tubing bearing an orifice holder opposite the exit port and having a gas pilot orifice secured in the orifice holder;

an actuating mechanism sized and mounted within the device so as to provide an optimized internal flow path allowing unrestricted flow of gas through the device when the mechanism is not actuated, the actuating mechanism being comprised of:

a plunger rod having a free end and a secured end;

a clean-out pin mounted to the free end of the plunger rod, the pin having a diameter sized to allow it to pass through the pilot orifice; and a push button assembly attached to the secured end of the plunger, the push button assembly being comprised of:

a push button nut for securing the assembly to the gas pilot opening;

a push button mounted within the push button nut, the push button having a gas-tight, high-temperature, redundant seal to prevent gas leakage and entry of contaminants and debris into the gas pilot; and a spring located around the plunger and substantially between the push button and the opening of the pilot.

4. A semi-automatic gas pilot orifice clean-out device for cleaning a gas pilot orifice of an agricultural brooder or other appliance that utilizes a gas pilot as an ignition source, the brooder or other appliance having a gas pilot, a pressurized gaseous fuel supply, a gas supply line connecting the gaseous fuel supply to the gas pilot, the clean-out device comprising:

a T-shaped tube having an inlet port adapted for attachment to the gas supply line, an exit port and an actuating mechanism opening, the inlet and exit port being in flow-through communication and the opening being coaxial with and opposite the exit port;

a section of tubing attached to the exit port, the section of tubing bearing an orifice holder opposite the exit port and having a gas pilot orifice secured in the orifice holder;

an actuating mechanism sized and mounted within the device so as to provide an optimized internal flow path allowing unrestricted flow of gas through the device when the mechanism is not actuated, the actuating mechanism being comprised of:

a plunger rod having a free end and a secured end;

a clean-out pin mounted to the free end of the plunger rod, the pin having a diameter sized to allow it to pass through the pilot orifice; and a push button assembly attached to the secured end of the plunger, the push button assembly being comprised of:

a push button nut for securing the assembly to the gas pilot opening;

a push button mounted within the push button nut, the push button having at least three annular grooves with a high-temperature O-ring positioned in each groove in order to provide a gas-tight, redundant seal and having an internal recess for receiving the secured end of the plunger rod, the plunger rod being secured within the recess; and a spring located around the plunger rod and substantially between the push button and the opening, so that when the spring is extended gas flows through the gas pilot and when the spring is compressed the clean-out pin passes through the gas pilot orifice.

5. A gas pilot with semi-automatic clean-out device, comprising:

a gas pilot comprised of a tubular housing having a longitudinal length and two ends, a gas orifice with an orifice exit port, the gas orifice being located at one end of the housing, a gas pilot opening at the other end of the housing, the opening being configure and adapted to receiving an actuating mechanism, a gas inlet port configured for flow-through attachment to a pressurized gaseous fuel supply, an actuating mechanism coaxially located within the housing, the actuating mechanism being comprised of a plunger rod having a free end bearing a clean-out pin and a secured end, a push button assembly in gas-tight, redundantly sealed attachment to the gas pilot opening, wherein the plunger moves toward the gas orifice and pushes the clean-out pin through the orifice exit port when the actuating mechanism is actuated and returns to an open position when the mechanism is not actuated.

6. A gas pilot with semi-automatic clean-out device, comprising:

a gas pilot comprised of a tubular housing having a longitudinal length and two ends, a gas orifice with an orifice exit port, the gas orifice being located at one end of the housing, a gas pilot opening at the other end of the housing, the opening being configure and adapted to receiving an actuating mechanism, a gas inlet port configured for flow-through attachment to a pressurized gaseous fuel supply, an actuating mechanism coaxially located within the housing, the actuating mechanism being comprised of:

a plunger rod having a free end and a secured end;

a clean-out pin mounted to the free end of the plunger rod, the pin having a diameter sized to allow it to pass through the pilot orifice; and a push button assembly attached to the secured end of the plunger, the push button assembly comprising a push button nut for securing the assembly to the gas pilot opening; a push button mounted within the push button nut, the push button having a high-temperature, redundant sealing system to provide a gas-tight, redundant seal to prevent gas leakage and entry of contaminants and debris into the gas pilot, the actuating mechanism being actuated by the push button to push the plunger rod in the direction of the gas orifice; and a spring for returning the plunger rod to an open position, the spring being located around the plunger and substantially between the push button and the opening of the pilot.

7. A gas pilot with semi-automatic clean-out device, comprising:

a gas pilot comprised of a tubular housing having a longitudinal length and two ends, a gas orifice with an orifice exit port, the gas orifice being located at one end of the housing, a gas pilot opening at the other end of the housing, the opening being configure and adapted to receiving an actuating mechanism, a gas inlet port configured for flow-through attachment to a pressurized gaseous fuel supply, an actuating mechanism coaxially located within the housing, the actuating mechanism being comprised of:

a plunger rod having a free end and a secured end;

a clean-out pin mounted to the free end of the plunger rod, the pin having a diameter sized to allow it to pass through the pilot orifice; and a push button assembly attached to the secured end of the plunger, the push button assembly being comprised of:

a push button nut for securing the assembly to the gas pilot opening;

a push button mounted within the push button nut, the push button having at least three annular grooves with a high-temperature O-ring positioned in each groove in order to provide a gas-tights, redundant seal and having an internal recess for receiving the secured end of the plunger rod, the plunger rod being secured within the recess; and a spring located around the plunger rod and substantially between the push button and the opening, so that when the spring is extended gas flows through the gas pilot and when the spring is compressed the clean-out pin passes through the gas pilot orifice.

8. A gas pilot with semi-automatic clean-out device, the gas pilot comprising a T-shaped housing and a clean-out device, the housing being adapted and configured for flow-through communication with a gas supply line connected to a pressurized gaseous fuel supply and having an inlet port, a gas outlet and an opening, and the clean-out device being comprised of a plunger rod having a free end and a secured end, a clean-out pin mounted to the free end and a push button assembly attached to the secured end, the clean-out device being coaxially located within the housing and attached thereto by the push button assembly in redundantly sealed, gas-tight relationship; wherein when the push button assembly is actuated, the plunger rod moves toward the gas outlet and the clean-out pin passes through the outlet and when the clean-out device is not actuated, the plunger rod returns to an open position.

9. The actuating mechanism of claim 1 or claim 2, wherein the gas pilot has an internal volume and the plunger rod is sized relative to the internal volume of the gas pilot to provide an optimized internal gas flow path when the spring is in an extended position.

10. The device of claim 3 or claim 4, wherein the device has an internal volume and the plunger rod is sized relative to the internal volume of the gas pilot to provide an optimized internal gas flow path when the spring is in an extended position.

11. The gas pilot of any one of claims 5 to 8, wherein the gas pilot has an internal volume and the plunger rod is sized relative to the internal volume of the gas pilot to provide an optimized internal gas flow path when the spring is in an extended position.

12. The actuating mechanism of claim 1 or claim 2, wherein the redundant seal is lubricated with a high-temperature grease lubricant.

13. The device of claim 3 or claim 4, wherein the redundant seal is lubricated with a high-temperature grease lubricant.

14. The gas pilot of any one of claim 6 or 7, wherein the redundant seal is lubricated with a high-temperature grease lubricant.

* * * * *